427-230 SR
2/11/86 OR 4,569,860

United States Patent [19]
Williams et al.

[11] Patent Number: 4,569,860
[45] Date of Patent: Feb. 11, 1986

[54] SYSTEM FOR REFURBISHING THE INSIDE SURFACE OF A CHAMBER

[75] Inventors: Virgil R. Williams, Snellville; James M. Williams, Jr., Atlanta; Jack D. Lane, Stone Mountain, all of Ga.

[73] Assignee: Williams Contracting, Inc., Stone Mountain, Ga.

[21] Appl. No.: 444,369

[22] Filed: Nov. 26, 1982

[51] Int. Cl.[4] ..... B05D 7/22
[52] U.S. Cl. ..... 427/230; 427/239; 427/282; 427/295; 427/299; 427/318; 427/374.1; 427/384
[58] Field of Search ..... 427/230, 282, 299, 295, 427/374.1, 384, 239, 318

[56] References Cited

U.S. PATENT DOCUMENTS

| | | | |
|---|---|---|---|
| 4,096,300 | 6/1978 | William et al. | 427/327 |
| 4,248,914 | 2/1981 | McClane | 427/282 |
| 4,331,716 | 5/1982 | Stark | 427/421 |
| 4,428,985 | 1/1984 | Bettolazzi | 427/230 |

*Primary Examiner*—Norman Morgenstern
*Assistant Examiner*—Janyce A. Bell
*Attorney, Agent, or Firm*—Thomas & Kennedy

[57] ABSTRACT

A substantially torus-shaped chamber is refurbished by installing partitions about the chamber to create isolated compartments within the chamber, and by sandblasting, painting, and curing the paint in the compartments and exhausting air from the compartments so that the dust and fumes from the compartments are not spread to adjacent ones of the compartments. In the curing process a plurality of insulated panels are installed in juxtaposed relationship with respect to the painted surfaces, and high velocity air is moved between the panels and the painted surfaces in closed paths. The recirculating air is heated to approximately 200° F. and the hot air is confined substantially to the space immediately adjacent the painted surface. A conduit system is formed about the perimeter of the insulated panels, and fluid, such as ambient air, is drawn through the conduit system in contact with the painted surface so as to form a heat sink at the perimeter of the insulated panels, to extract heat from the painted surface and prevent heat from spreading from the compartments being dried to the adjacent compartments.

6 Claims, 9 Drawing Figures

SYSTEM FOR REFURBISHING THE INSIDE SURFACE OF A CHAMBER

BACKGROUND OF THE INVENTION

Atomic energy power plants usually comprise a reactor with a fuel cell and a plurality of downcomers that extend from the reactor in downward directions into a torus-shaped chamber positioned below and about the reactor. The torus-shaped chamber is partially filled with deionized water, and the lower open ends of the downcomers are submerged in the water. If the reactor should overheat, steam from the reactor will move through the downcomers and into the deionized water in the torus-shaped chamber.

The typical torus-shaped chamber used in connection with an atomic reactor is oriented in a horizontal attitude and is a substantially closed chamber, in that only small manhole openings are located in a few positions about the upper portion of the chamber. The typical chamber size has an inside height of 30 feet with an overall diameter of about 90 feet. The approximately torus-shaped chamber is formed by 16 cylindrical segments merged end-to-end to form an anulus, with each cylindrical segment forming a bay of the chamber. The deionized water fills the lower one-half portion of the torus, and various catwalks, scaffolds and ductwork are mounted throughout the chamber so as to provide access for the workers within the chamber and to provide ventilation, etc.

It is necessary to refurbish the reactor, including the torus-shaped chamber, from time to time. When refurbishing the chamber, the water is removed from the chamber, and the refurbishing process usually comprises sandblasting the inside surfaces of the chamber, particularly the surfaces normally below the water line, applying several coats of paint to the surfaces, and then drying or curing the painted surfaces.

When the atomic reactor is shut down, it is estimated that the value of the electrical current not generated during shutdown is $750,000.00 per day. Thus, it is important that the refurbishing process should be achieved rapidly.

In the past, a multiple number of workers have been used simultaneously to achieve the refurbishing process. The step of sandblasting was accomplished on a mass basis, and after the sandblasting had been achieved and the sand removed from the chamber, the painting began. Usually the paint was applied in three coats, with each coat requiring twenty-four hours drying time with heated air at less than 65% percent humidity circulated through the chamber. The drying procedure included moving air from outside the chamber through the chamber and heating the air as it entered the chamber to increase the drying effect of the air. In addition, after all three coats of paint were applied to the inner surfaces of the torus-shaped chamber, it was necessary to cure the paint for a prolonged period. Of course, the increased temperature of the drying air and the fumes in the air made it so uncomfortable for workers within the chamber that other work would stop as the chamber was being dried.

SUMMARY OF THE INVENTION

Briefly described, the present invention comprises a system of refurbishing a torus-shaped chamber or other large chambers which require sandblasting, painting and curing of the paint. The chamber is divided into compartments by the hanging of curtains and separate refurbishing steps are performed in each compartment. Preferably, the compartments in which work is being accomplished are separated from other work compartments by inactive compartments so as to further separate the work functions about the chamber. Air is supplied to and exhausted from each bay so that dust from a compartment which is being sandblasted tends to be exhausted from its compartment rather than to be transmitted to other compartments about the chamber, and the fumes from the paint tend to be exhausted from their compartment rather than to be transmitted to other compartments about the chamber.

In addition, structural heat barriers are formed in closely spaced relationship with the surfaces in those bays where the paint is being cured, and high velocity air is moved in the space between the painted surfaces of the bay and the structural heat barrier. The drying air moves in a substantially closed path, and the air is heated as it moves in its path so that high temperature, high velocity air is applied to the painted surfaces which tends to remove the thermal barrier adjacent the painted surfaces and accelerate the drying function. Ductwork is formed at the perimeter of a structural heat barrier and unheated air is directed through the ductwork in contact with the painted surface so as to form a heat sink about the perimeter of the structural heat barrier, and thereby to minimize the transfer of heat from the bay where the paint is being cured to the next adjacent bay.

The insulated barrier comprises a plurality of elongate insulated panels that are of a width small emough for passage through the manhole openings into and out of the torus-shaped chamber, and the panels are arranged in edge-to-edge relationship with the lengths of the panels extending logitudinally with respect to the cylindrically-shaped bays of the torus-shaped chamber. The panels are supported from the painted surface, and the plurality of panels tend to conform to the shape of the chamber. The panels form an envelope with the painted surface so as to isolate the surface which is to be dried from the interior of the chamber.

Thus, it is an object of this invention to provide an improved process for refurbishing a substantially torus-shaped chamber, wherein a multiple number of refurbishing steps can be achieved simultaneously so as to expedite the refurbishing process.

Another object of this invention is to provide a paint curing procedure for curing the paint in a large chamber, wherein high velocity, high temperature air is circulated in a path next adjacent the painted surface so as to heat the paint and to remove the thermal barrier from adjacent the painted surface and thereby rapidly dry the paint.

Another object of this invention is to provide a method and apparatus for curing paint in a substantially torus-shaped chamber while other refurbishing steps are being performed, by forming an envelope about the painted surface of a chamber, applying high velocity, high temperature air to the painted surface within the envelope, retarding the transfer of heat from the surfaces being dried to adjacent surfaces, and exhausting the waste air from the chamber without comingling the waste air with air in other bays of the chamber.

Another object of this invention is to provide a method and apparatus for expediently curing painted surfaces in a large chamber while other work is being performed within the chamber, by directly applying heated, high velocity air to the painted surfaces and exhausting the fumes with waste air from the chamber without generally circulating the waste air throughout the chamber.

Other objects, features and advantages of the present invention will become apparent upon reading the following specification, when taken in conjunction with the company drawings.

DETAILED DESCRIPTION

Figure 1:
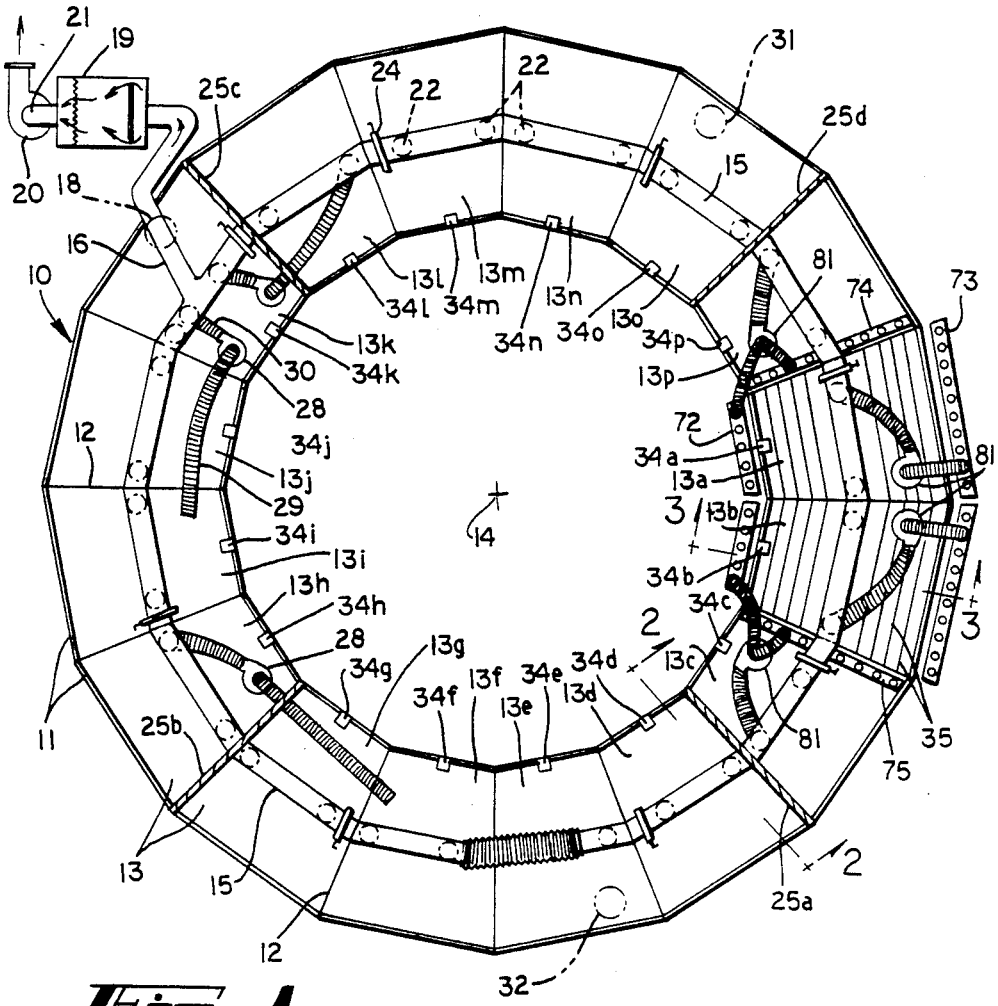
FIG. 1 is a schematic plan view of the substantially torus-shaped chamber of the type utilized with an atomic power plant, showing the air ventilation conduits, the partitions to divide some of the bays of the chamber from others of the bays, and the insulated panels applied to the inside lower surface of a pair of adjacent bays for the purpose of curing the paint that has been applied to the lower inside surface of the bays in the chamber.

Referring now in more detail to the drawings, in which like numerals indicate like parts throughout the several views, FIG. 1 schematically illustrates the approximately torus-shaped chamber 10 which is to be refurbished by sandblasting, painting and curing of the paint. The chamber 10 is formed from a series of cylindrical sections 11 which have an inside diameter of approximately 30 feet. The cylindrical sections are arranged in an abutting end-to-end relationship to form the large donut shape of the chamber 10. It will be noted that the lines of connection 12 of abutting cylindrical sections 11 are approximately parallel to a radiant from the center 14 of the structure, and that the cylindrical sections are longer at their portions more distant from the center 14 than they are at their portions closer to the center 14.

Each cylindrical section 11 comprises a bay 13. In the embodiment illustrated, there are 16 compartments 13A-13P.

Chamber 10 is used in association with an atomic reactor and its fuel cell (not shown), and the chamber is usually one-half filled with deionized water. Catwalks, scaffolding, ductwork and other items are located throughout the chamber (generally not shown), with most of these items being located above the water line. For example, a permanent ductwork 15 extends about the approximately torus-shaped chamber, with an exhaust conduit 16 extending through an opening 18 and connected to a filter room 19. Blower 20 has its inlet connected to exhaust conduit 21 and filter room 19, so as to create a flow of exhaust air from chamber 10. Openings 22 are formed in the internal ductwork 15, and valves control the openings so that air can be exhausted from selected areas of the chamber.

When the torus-shaped chamber 10 is to be refurbished, the first phase is to make whatever structural corrections are necessary to the space, as by removing old scaffolding, catwalks, conduits, fittings, etc. and installing the new equipment. After the old equipment has been removed, sandblasting usually takes place before the new equipment is installed. In addition, the space is painted and the painted surfaces are cured, preferably before the new equipment is installed.

Figure 2:
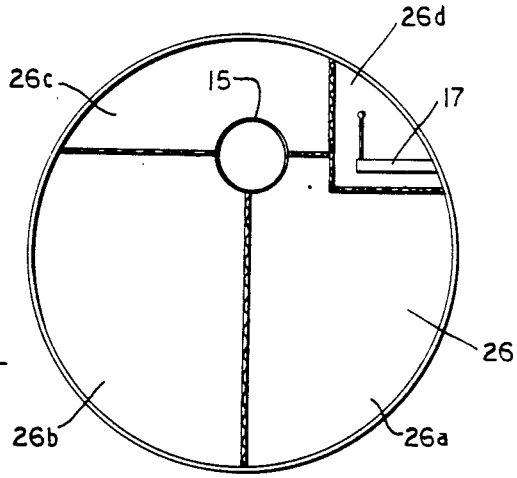
FIG. 2 is a schematic cross-sectional view of a bay, showing a partition formed between adjacent bays, taken along lines 2—2 of FIG. 1.

Prior to the sandblasting phase, partitions 25 are installed internally within the chamber. As illustrated in FIG. 2, the partitions comprise nylon curtains 26 which are mounted in the most expedient way about the obstructions within the chamber. For example, the partition illustrated in FIG. 2 comprises curtain section 26A, 26B, 26C and 26D that are mounted about the internal ductwork 15 and catwalk 17, with the sections of the curtains being laced together with rope extending through grommets at the adjacent edges of the curtains. The curtains are suspended from the support beams (not shown) of the chamber with the outer edges of the sections of the curtains formed to correspond to the internal shape of the chamber. The partitions 25 are installed within the chamber at positions which will divide the chamber into work compartments of two or more bays. For example, partitions 25A and 25B are illustrated as having been installed to separate bays 13D-13G from the other bays, while curtains 25B and 25C separate bays 13H-13K from the other bays, and curtains 25C and 25D separate bays 13L-13O from the other bays, and partiion 25D and 25A separate bays 13P, 13A, 13B and 13C from the other bays.

The work of refurbishing the chamber will be performed progressively, in that the modifications to the chamber will be performed progressively throughout the chamber while sandblasting, painting and curing of the paint will follow progressively. When the phases of sandblasting and painting and curing of the paint begin, the partitions 25A-25D become important in that the functions are separated from one another, and the ventilation system tends to supply air to and exhaust air from the sections between the partitions and tend to prevent the air from one section comingling with the air of other sections. The air-born debris from the sandblasting function usually is exhausted through the ductwork 15 from one section while the paint fumes usually will be exhausted from another section by the same ductwork. In addition, the air movement is enhanced by the use of additional blowers 28, which include flexible inlet conduits 29 that can be extended to remote areas and flexible exhaust conduits 30 that connect to the internal ductwork 15. The makeup air is supplied through the equipment hatch 31, personnel hatch 32, and through the downcomer openings 34A–34P.

Figure 3:
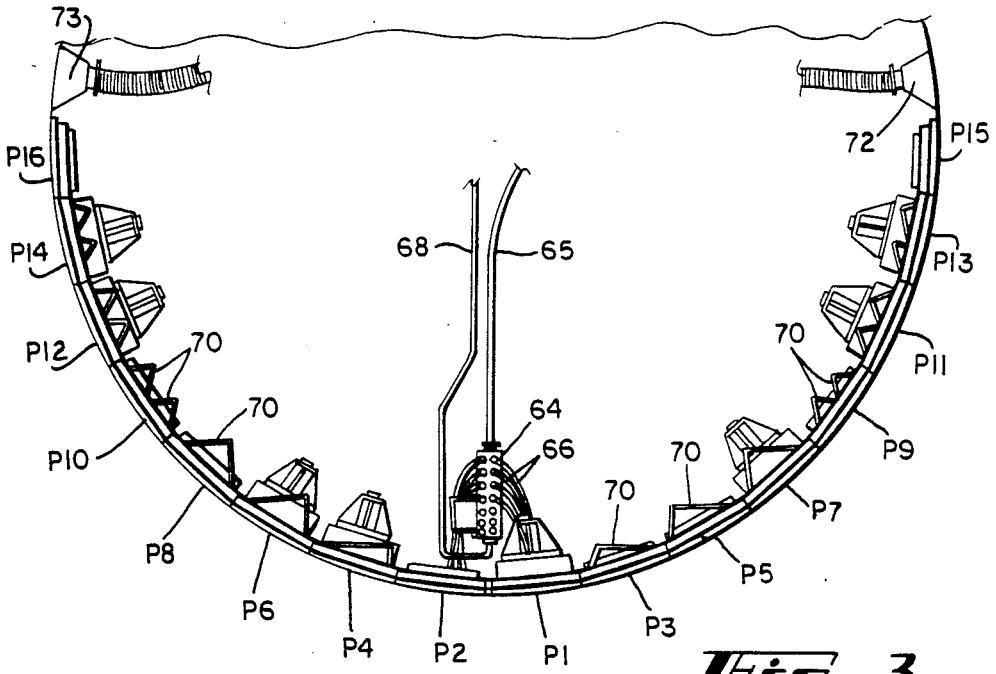
FIG. 3 is a partial cross-sectional view of a compartment of the chamber of FIG. 1, taken along lines 3—3 of FIG. 1, showing the lower portion of the bay with the heat-insulated panels applied to the interior surface of the bay.
Figure 4:
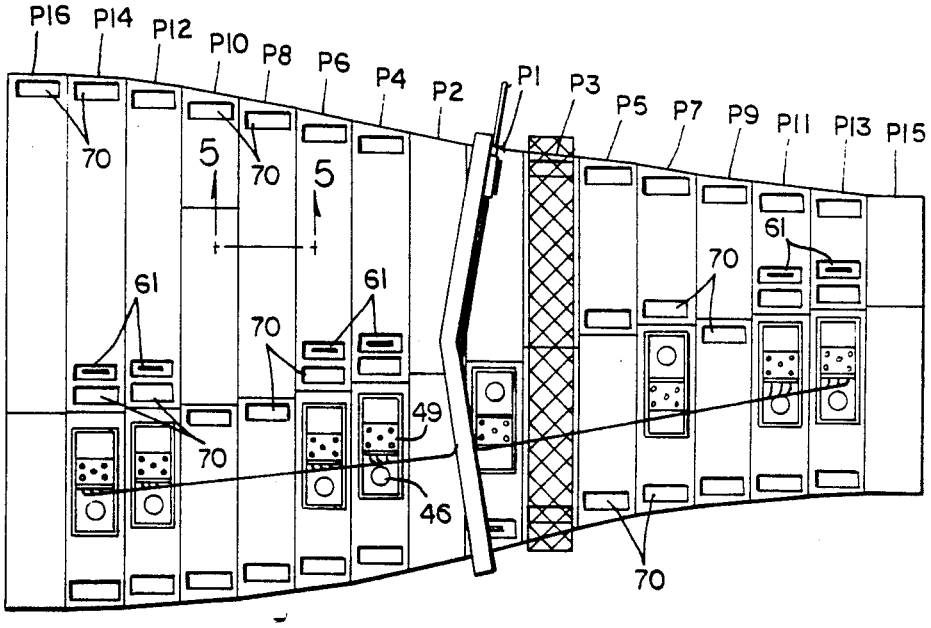
FIG. 4 is a developed plan view of the heat-insulated panels illustrated in edge-to-edge arrangement as installed in a bay.

When a section of the chamber 10 has been sandblasted and painted and the paint is to be cured, a plurality of insulated rectangular panels 35 are placed in edge-to-edge relationship and are located in closely spaced relationship with relationship to the painted surface of the chamber. The panels 35 vary in length, and the panels are installed with their lengths parallel to one another and parallel to the length of their bay, beginning at the bottom center of the bay and extending progressively upwardly from each side of the center. As illustrated in FIG. 3, panels P1 and P2 are located at the lowermost portion of the bay, while panels P3, P5, P7, P9, P11, P13 and P15 extend laterally and upwardly from panel P1, while panels P4, P6, P8, P10, P12, P14 and P16 extend laterally and upwardly from panel P2. In the embodiment illustrated, the panels P1–P16 are formed in two or more sections so as to expedite the handling and installation of the panels within the chamber. It will be noted that the panels closer to the center 14 of the substantially torus-shaped chamber are shorter than those panels located further away from the center, as shown in FIG. 4.

Figure 5:
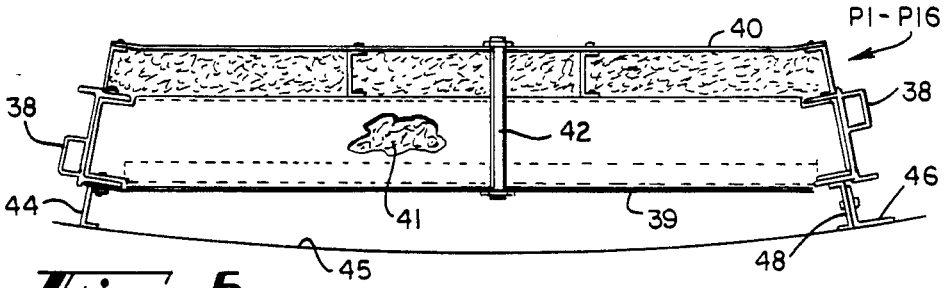
FIG. 5 is an end cross sectional view of a heat-insulated panel of FIG. 4, taken along lines 5—5 of FIG. 4.

As illustrated in FIG. 5, insulated panels P1–P16 each include an outer peripheral frame formed by a aluminum extrusions 38, with the extrusions 38 being arranged so as to interfit with similar extrusions on the next adjacent panels. Sheets 39 and 40 close the frame formed by the extrusions 38, and insulation such as fiberglass insulation 41 fills the space within the frame and between the sheets. A tube 42 extends through the panel to form a thermometer well to accomodate a temperature sensor. The assembled panel structure further includes support legs 44 at its side edges which are arranged to support the insulated panel from the painted surface 45 of the chamber. The support legs 44 extend along the length of the panel, and the support legs are formed of fiberglass. A neoprene strip 46 is attached to at least one support leg 44 of each panel, and the strip 46 extends into overlying abutment with the painted surface 45 so as to form a seal against the painted surface. The support legs with the rest of the panel form an envelope about the paint and a passage for the movement of air, as will be explained more fully hereinafter.

Figure 7:
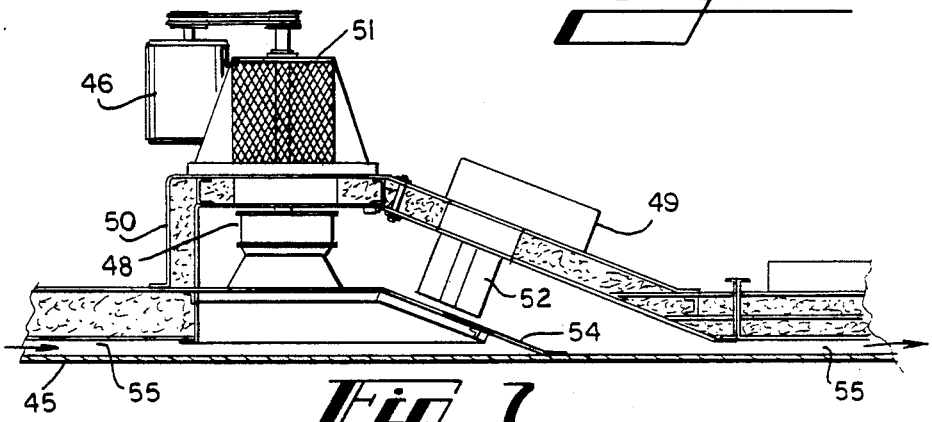
FIG. 7 is a cross-sectional view of one of the heat-insulated panels, showing the central portion of the panel, and taken along the longitudinal centerline of the panel, showing the fan and heater.

The insulated panels of FIG. 5 are structured so as to work in pairs. One panel will include a motor, blower and heater and the associated ductwork for handling the air to move through the blower and heater, while its companion panel does not require the motor, blower and heater. For example, panels P1, P7, P11, P13, P4, P6, P12 and P14 all include a motor 46, a blower 48 (FIG. 7) and a heater 49. As illustrated in FIG. 7 those panels that include the motor, blower and heater have an upwardly protruding insulated housing 50 mounted on the upper surface of the panel, with the motor 46 mounted on the housing, and with the bearing structure mounted over the housing, and with the impeller of the blower 48 located in the housing. Electric heater 49 has its heated element 52 suspended down into the housing. Housing 50 includes a baffle plate 54 that extends adjacent heating element 52, and when impeller 48 is rotated by motor 46, air is drawn through the space 55 between the painted surface 45 and lower portion of the insulated panel up into the housing 50, and the air is expelled by the impeller out of the housing, in the direction as dictated by baffle 54 about heating element 52 back down into the space 55 beneath the insulated panel. Preferably, the heating element 52 is a "black heat" type element in that it does not turn red, so as to minimize the possibility of ignition or explosion within the chamber.

Figure 6:
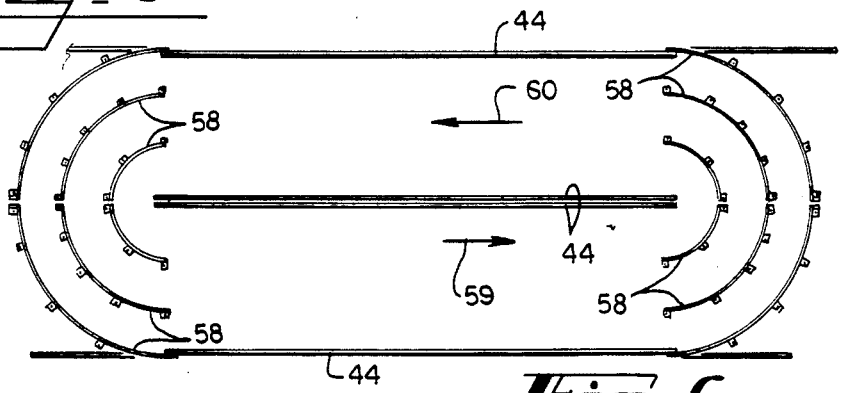
FIG. 6 is a bottom view of a pair of adjacent heat-insulated panels of FIGS. 3-5.

As illustrated in FIG. 6, turning vanes 58 are mounted to the lower surface of each panel P1–P16, at the ends of each panel. The turning vanes of each panel extend through an arc of 90 degrees, and the vanes of one panel of a pair of panels mates with the vanes of the other panel so as to form a 180 degree arc. This tends to direct the air moved by the blower along the lengths of the panels in a closed path, so that the air is continuously recirculated by the blower. Therefore, the air is moved first in one direction as indicated by arrow 59 along the length of one panel until it reaches the end of that panel, and then the air is turned through 180 degrees by the turning vanes so that it moves in the opposite direction as indicated by arrow 60 along the length of the other panel until it reaches the turning vanes at the other end, whereupon the air is redirected back along the length of the first panel.

When the air is moved and heated and then directed in a closed path beneath the panels adjacent the painted surface of the chamber, the velocity of the air tends to wipe away the thermal barrier adjacent the painted surface of the chamber, and the high temperature and high velocity of the air tends to rapidly dry the paint. As the air becomes saturated with solvent vapor, it is desirable to progressively replace the saturated air with unsaturated air. For this purpose manually operated ventilation doors 61 are placed in the insulated panels at positions downstream of the blowers, so that when the ventilation doors are opened, a portion of the circulating air is permitted to escape from beneath the insulated panels. Makeup air is provided by the natural leakage of air through and about the panels to the air path.

As illustrated in FIG. 3, a power distribution cabinet 64 is electrically connected through its flexible armored cable 65 to a source of power, and the electrical leads 66 extend from the cabinet to each blower motor and heater of the pairs of panels. Compressed air is supplied through conduit 66 to power distribution cabinet 64 to purge the cabinet of fumes, etc.

As illustrated in FIGS. 3 and 4, stairsteps 70 are formed on the upper surfaces of the insulated panels P1–P16, with the steps being oriented differently for different ones of the panels so as to provide a substantially horizontal step surface for workmen, etc.

Figure 9:
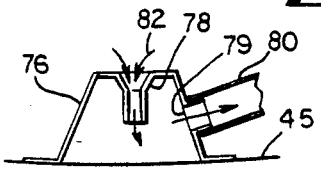
FIG. 9 is a detail, cross-sectional illustration of the arcuate cooling duct, taken along lines 9—9 of FIG. 8.
Figure 8:
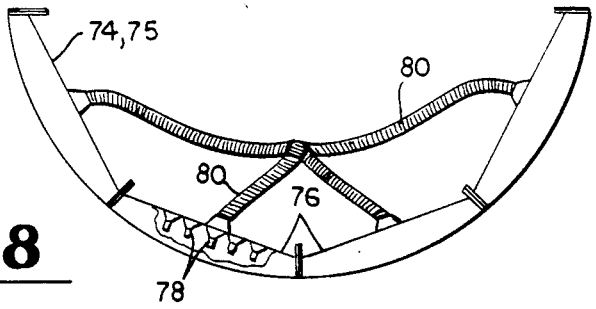
FIG. 8 is a schematic end cross-sectional view of a compartment of the chamber, showing the arcuate cooling duct applied to the lower portion of the compartment.

As illustrated in FIGS. 1 and 3, cooling ductwork is formed about the perimeter of the insulated panels P1–P16. The rectilinear cooling ducts 72 and 73 are located above insulated panels P15 and P16, while the arcuate cooling ducts 74 and 75 are located at the ends of the panels. The cooling ducts are in open communication with the painted surface, and as illustrated in FIGS. 8 and 9, comprise an inverted, elongated trough 76 that is arranged to rest upon the painted surface 45, and Venturi nozzles 78 are formed in the trough 76 at closely space intervals along the trough. Exhaust openings 79 are located at spaced intervals along the trough, and flexible conduits 80 extend from the exhaust openings 79 to the inlet of blowers 81. The exhaust ducts of the blowers are connected to interior ductwork 15. FIG. 8 illustrates the arcuate cooling ducts 74, 75 which comprise rectilnear duct sections with arcuate skirts that conform to the shape of the painted surface. The Venturi nozzles 78 are arranged to direct the flow of air as indicated by arrows 82 toward right angle impingement against the painted surface 45 so as to break up the heat barrier at the painted surface. After air has impinged against the painted surface, it tends to disperse within the inverted through-like ductwork 76 and move along the length of the ductwork and then out of the opening 79 and toward the inlet of the blower. The nozzles 78 closer to the middle of the arcuate ductwork are longer than those nozzles near the ends of the arcuate ductwork so that the air is carried close to the painted surface before it is expelled from the nozzle, thereby assuring that high velocity air impinges against the painted surface.

The unheated air that is drawn through the rectilinear and arcuate cooling ducts 72–75 tend to absorb heat from the painted surface, so that the heat supplied to the painted surface by the insulated panels P1–P16 is extracted from the painted surface before the heat is permitted to spread throughout the chamber. This tends to reduce the temperature of the entire chamber, particularly within the group of bays where the paint is being cured.

While this invention has been described in detail with particular reference to a preferred embodiment thereof, it will be understood that variations and modifications can be effected within the spirit and scope of the invention as described hereinbefore and as defined in the appended claims.

We claim:

1. A process of refurbishing the inside surfaces of a substantially torus-shaped chamber formed from a plurality of cylindrically-shaped bays in end-to-end relationship comprising the steps of forming partitions in the chamber to divide the inner space of the chamber into compartments of several bays positioned about the chamber, progressively sandblasting the surfaces of each compartment of the chamber, after each compartment has been sand blasted simultaneously while sand blasting other compartments painting the surfaces of each compartment of the chamber which has already been sandblasted, and after each compartment has been painted curing the paint on the surfaces of each compartment of the chamber which has already been sandblasted and painted, and simultaneously circulating air to each compartment independently of the other compartments so as to avoid contaminents from one compartment entering another compartment.

2. The process of claim 1 and wherein the step of forming partitions in the chamber comprises forming the partitions about at least three bays to form a compartment having at least three bays, and wherein the steps of sandblasting, painting and curing are performed in compartments separated by other bays.

3. The process of claim 1 and wherein the step of curing the paint comprises placing an insulated barrier in a bay in closely spaced relationship to the painted surfaces to be cured, recirculating air in the space between the barrier and the painted surfaces, heating the air as the air is recirculated, and exhausting a portion of the air from the space between the barrier and the painted surface.

4. The process of claim 3 and further comprising the step of inducing a flow of cooling fluid to move in contact with surfaces of the bay about the perimeter of the insulated barrier and exhausting the cooling fluid from the bay.

5. The process of claim 3 and wherein the step of placing an insulated barrier in a bay in closely spaced relationship to the painted surfaces to be cured comprises placing a series of elongate panels in edge-to-edge relationship with one another and oriented to extend parallel to the length of the bay and arranged in approximately parallel justaposition with the painted surface to be cured, and wherein the step of recirculating air in the space between the barrier and the painted surfaces comprises moving air in one direction along the length of one panel between the panel and the painted surfaces and then directing the air from the end portion of the one panel and along the length of an adjacent panel in the opposite direction, and wherein the step of heating the air comprises heating the air as it moves along the length of one of the panels.

6. The process of claim 5 and wherein the step of placing a series of elongate panels in edge-to-edge relationship with one another comprises orienting each panel so that its central portion is approximately parallel to the central portion of the surface that the panel covers, whereby the series of panels generally conform to the curvature of their bay.

* * * * *